US008475068B2

(12) United States Patent
Yoshioka

(10) Patent No.: US 8,475,068 B2
(45) **Date of Patent: *Jul. 2, 2013**

(54) PRINTER SELECTIVELY HAVING CONFIGURATIONS FOR RECEIPT PRINTER AND FOR TICKET PRINTER

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/174,942

(22) Filed: Jul. 1, 2011

(65) Prior Publication Data

US 2011/0262203 A1 Oct. 27, 2011

Related U.S. Application Data

(62) Division of application No. 12/182,679, filed on Jul. 30, 2008, now Pat. No. 8,096,718.

(30) Foreign Application Priority Data

Jul. 31, 2007 (JP) ..... 2007-199583

(51) Int. Cl.

| | |
|---|---|
| ***B41J 11/00*** | (2006.01) |
| ***B41J 11/42*** | (2006.01) |
| ***B41J 11/70*** | (2006.01) |
| ***G07B 5/00*** | (2006.01) |
| ***G07G 1/06*** | (2006.01) |

(52) U.S. Cl.
USPC ..... 400/621; 400/691; 400/693

(58) Field of Classification Search
USPC ..... 400/621, 621.1, 691, 693
See application file for complete search history.

(56) References Cited

U.S. PATENT DOCUMENTS 7,346,300 B2 * 3/2008 Inami et al. ..... 399/274

FOREIGN PATENT DOCUMENTS

| | | | |
|---|---|---|---|
| JP | 6034454 | U | 3/1985 |
| JP | 3-125698 | U | 12/1991 |
| JP | 3-126598 | * | 12/1991 |
| JP | 8118755 | A | 5/1996 |
| JP | 1135195 | A | 2/1999 |
| JP | 2001-310512 | A | 11/2001 |
| JP | 2002-046307 | A | 2/2002 |
| JP | 2002200815 | A | 7/2002 |
| JP | 2002-361959 | A | 12/2002 |
| JP | 2004-106500 | A | 4/2004 |
| JP | 2006123229 | A | 5/2006 |

OTHER PUBLICATIONS

Communication dated Oct. 17, 2012 from the Japanese Patent Office in counterpart Japanese application No. 2011-083118.

* cited by examiner

*Primary Examiner* — Matthew G Marini
*Assistant Examiner* — Marissa Ferguson Samreth
(74) *Attorney, Agent, or Firm* — Sughrue Mion, PLLC

(57) ABSTRACT

A printer according to the present invention selectively comprises, a cutting configuration for a receipt printer for printing a receipt and a cutting configuration for a ticket printer for printing a ticket, as a cutting configuration for cutting a printed part of the paper roll. The cutting configuration for the receipt printer includes a fixed blade mounted to the upper frame and a movable cutter unit mounted on the lower frame to oppose the fixed blade through the paper roll to be driven by a driving source to cut the paper roll. The cutting configuration for the ticket printer includes a hand cutter mounted to at least one of the upper frame and the lower frame.

4 Claims, 3 Drawing Sheets

PRINTER SELECTIVELY HAVING CONFIGURATIONS FOR RECEIPT PRINTER AND FOR TICKET PRINTER

CROSS-REFERENCE TO RELATED APPLICATION

This application is a divisional of U.S. patent application Ser. No. 12/182,679 filed Jul. 30, 2008, which is based upon and claims the benefit of priority from Japanese Patent Application No. 2007-199583, filed Jul. 31, 2007, the contents of all of which are incorporated herein by reference in their entirety.

BACKGROUND OF THE INVENTION

The present invention relates to a compact printer for performing printing on a paper roll, which is used for an electronic appliance such as a POS (Point Of Sale system) terminal.

The above-mentioned type of printer has a simple configuration and is advantageous in downsizing, cost reduction, and simplification of maintenance. Therefore, the printer is used for a wide variety of electronics, for example, a POS terminal for issuing a receipt or a ticketing device for ticketing tickets or coupons.

Among such printers, a receipt printer for printing receipts is disclosed in, for example, Japanese Patent Application Laid-open No. 2001-310512. The receipt printer has a cutting configuration for automatically cutting a printed part of a paper roll at an appropriate position (length).

On the other hand, a ticket printer for printing tickets or coupons is disclosed in Japanese Patent Application Laid-open No. 2002-361959. The ticket printer uses a paper roll having a perforated line at each predetermined position (at a predetermined interval) corresponding to one ticket. The printer has a hand cutter provided at a paper eject slot of the printer. A printed part of the paper roll is ejected to locate the perforated line at the position of the hand cutter to be cut by a user's hand.

Conventionally, each of the receipt printer and the ticket printer has a different cutting configuration. Therefore, a printer main body including a lower frame or an upper frame, on which the cutting configuration is mounted, is differently designed using different components for each of the receipt printer and the ticket printer. Therefore, a printer assembly line and a component delivery plan are different for each of the printers.

SUMMARY OF THE INVENTION

Therefore, the present invention has an object of providing a printer excellent in productivity, which has a configuration common to a receipt printer and a ticket printer to allow an assembly or component delivery plan to be established in a streamlined manner.

According to an aspect of invention, a printer for performing printing on a paper surface while feeding paper from a paper roll and comprising a lower frame on which the paper roll is loaded and an upper frame for openably covering the lower frame. The printer selectively comprises a cutting configuration for a receipt printer for printing a receipt and a cutting configuration for a ticket printer for printing a ticket as a cutting configuration for cutting a printed part of the paper roll. The cutting configuration for the receipt printer includes a fixed blade mounted to the upper frame and a movable cutter unit mounted on the lower frame to oppose the fixed blade through the paper roll to be driven by a driving source to cut the paper roll. The cutting configuration for the ticket printer includes a hand cutter mounted to at least one of the upper frame and the lower frame.

According to another aspect of invention, an electronic appliance comprising said the printer.

DETAILED DESCRIPTION OF THE PREFERRED EMBODIMENTS

Figure 1:
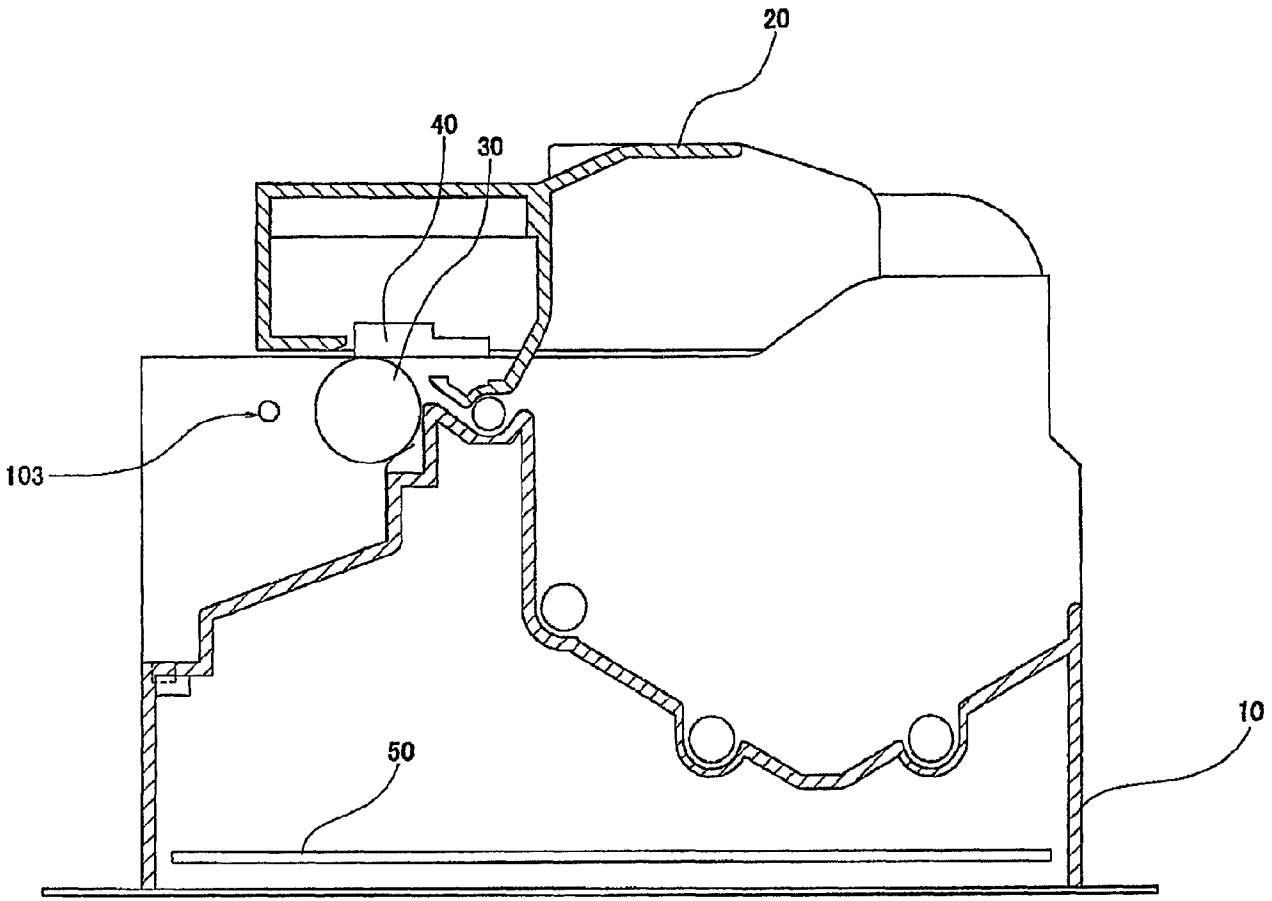
FIG. 1 is a sectional view illustrating a basic configuration of a printer according to an embodiment of the present invention.

A printer according to the present invention includes a lower frame, an upper frame, a platen, and a print head. On the lower frame, a paper roll is loaded. The upper frame openably covers the lower frame. The platen is mounted on the lower frame to feed paper from the paper roll. The print head performs printing on a paper surface on a circumferential surface of the platen.

As a cutting configuration for cutting a printed part of the paper roll, the printer selectively has a cutting configuration for a receipt printer and a cutting configuration for a ticket printer. The cutting configuration for the receipt printer includes a fixed blade mounted to the upper frame, and a movable cutter unit mounted on the lower frame to oppose the fixed blade through the paper roll to be driven by a driving source to cut the paper roll. On the other hand, the cutting configuration for the ticket printer includes a hand cutter mounted to at least one of the upper frame and the lower frame.

Further, the printer may also selectively have a front cover configuration for the receipt printer and a front cover configuration for the ticket printer as a front cover configuration for covering a front part of the lower frame and a front part of the upper frame. In this case, the front cover configuration for the receipt printer includes a first lower cover removably mounted on the lower frame and a first upper cover removably mounted on the upper frame. On the other hand, the front cover configuration for the ticket printer includes a second lower cover removably mounted on the lower frame and a second upper cover removably mounted on the upper frame. A first paper eject slot for the receipt printer, from which the printed part of the paper roll is ejected, is defined by an end of the first lower cover and an end of the first upper cover opposing the end of the first lower cover. On the other hand, a second paper eject slot for the ticket printer, from which the printed part of the paper roll is ejected, is defined by an end of the second lower cover and an end of the second upper cover opposing the end of the second lower cover.

The fixed blade is mounted to the first upper cover to be mounted on the upper frame through the first upper cover, whereas the movable cutter unit may be mounted on the first lower cover to be mounted on the lower frame through the first lower cover.

Further, the hand cutter may be formed on at least one of the end of the second upper cover and the end of the second lower cover in an integrated manner to be mounted on at least one of the upper frame and the lower frame through at least one of the second upper cover and the second lower cover.

Moreover, the printer may further selectively have a paper eject configuration for the receipt printer and a paper eject configuration for the ticket printer as a paper eject configuration for guiding the paper roll to the paper eject slot. In this case, the paper eject configuration for the receipt printer includes a first support path formed on the first lower cover to extend between the movable cutter unit and the end of the first lower cover. On the other hand, the paper eject configuration for the ticket printer includes a second support path formed on the second lower cover to extend toward the end of the lower cover to stop before reaching the end.

Further, the movable cutter unit may be driven by using the driving source of the platen.

Further, the printer may further include a jam sensor provided on the first upper cover to oppose the first support path on the first lower cover to detect a paper jam based on a raised paper plane of the paper roll on the first support path.

Hereinafter, an exemplary embodiment of the present invention will be described in detail.

[Basic Configuration]

A printer according to this embodiment is incorporated into, for example, an electronic appliance such as a POS terminal or a ticketing device, or is used as a stand-alone printer with the electronic appliance such as the POS terminal or the ticketing device. Both a receipt printer and a ticket printer are sometimes incorporated into a single POS terminal installed in a convenience store or the like. The printer in this embodiment may be used in such a usage pattern.

FIG. 1 illustrates a basic configuration of the printer according to the embodiment of the present invention.

Referring to FIG. 1, the printer in the embodiment includes a lower frame 10, an upper frame 20, a platen 30, a print head 40, and a control board 50 as a basic configuration. On the lower frame 10, a paper roll is loaded. The upper frame 20 openably covers the lower frame 10. The platen 30 is mounted on the lower frame 10 to feed paper from the paper roll. The print head 40 is, for example, a thermal print head which performs printing on a paper surface on a circumferential surface of the platen 30. The control board 50 is incorporated into the lower frame 10 to control an operation of the printer of the embodiment.

The above-mentioned basic configuration is commonly used for configurations for the receipt printer (cutting, front cover, and paper eject configurations) and configurations for the ticket printer (cutting, front cover, and paper eject configurations) descried below. In other words, the printer according to the present invention has general versatility to allow each of the receipt printer and the ticket printer to be configured.

The printer in this embodiment selectively has a cutting configuration for the receipt printer and a cutting configuration for the ticket printer as a cutting configuration for cutting a printed part of the paper roll.

Further, the printer in this embodiment selectively has a front cover configuration for the receipt printer and a front cover configuration for the ticket printer as a front cover configuration for covering a front part of the lower frame 10 and a front part of the upper frame 20.

Moreover, the printer selectively has a paper eject configuration for the receipt printer and a paper eject configuration for the ticket printer as a paper eject configuration for guiding the paper roll toward a paper eject slot.

Therefore, for the assembly of any of the receipt printer and the ticket printer, the basic configuration illustrated in FIG. 1 is first obtained by the assembly. In a subsequent step, the cutting configuration, the front cover configuration, and the paper eject configuration are obtained by the assembly, selectively for any of the receipt printer and the ticket printer.

[Receipt Printer]

Figure 2:
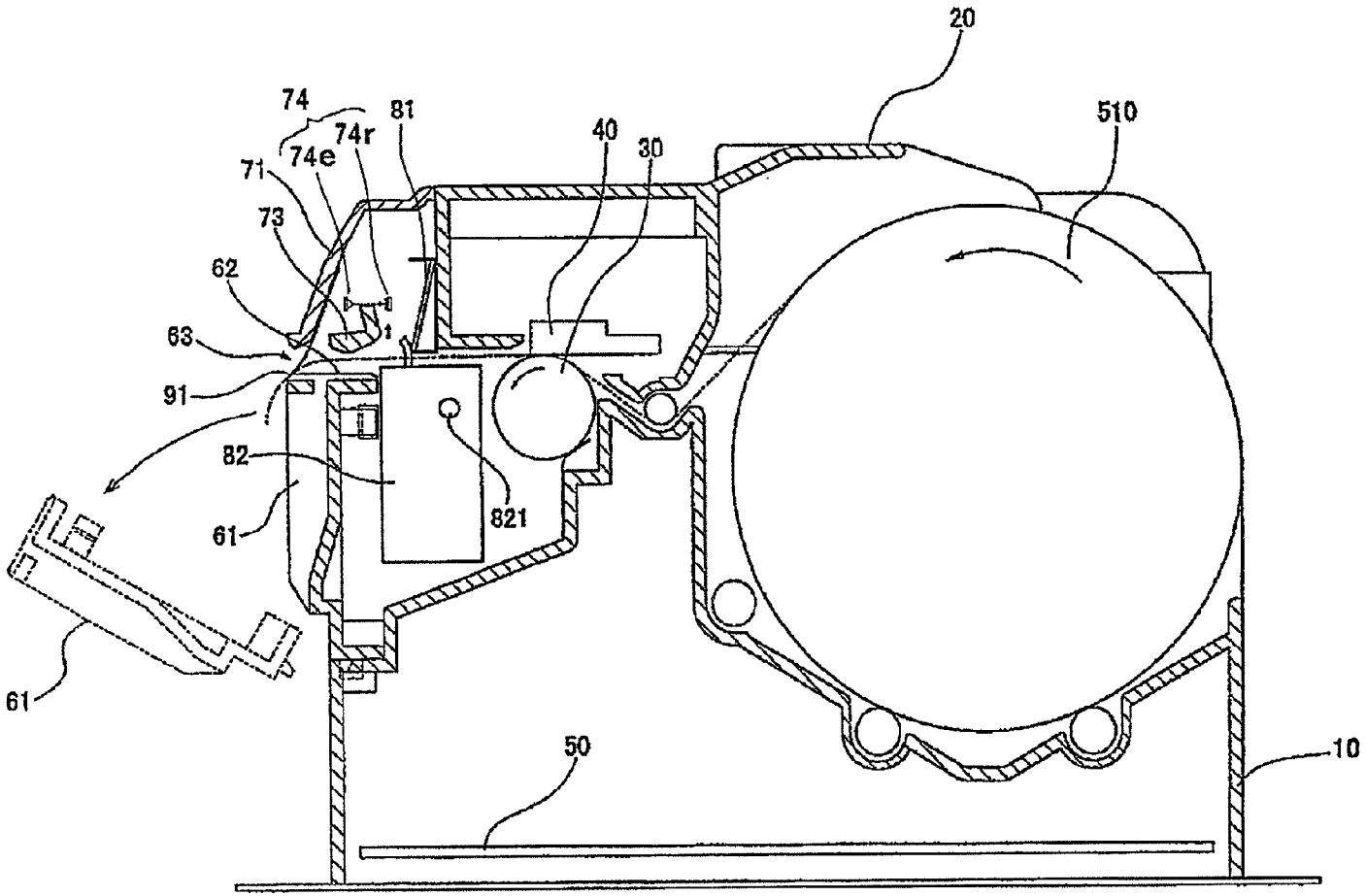
FIG. 2 is a sectional view illustrating a configuration of a receipt printer obtained by adding configurations for the receipt printer (cutting, front cover, and paper eject configurations) to the basic configuration illustrated in FIG. 1.

FIG. 2 illustrates a configuration applied when the configurations for the receipt printer (cutting, front cover, and paper eject configurations) are added to the basic configuration of the printer described above referring to FIG. 1 to be assembled into the receipt printer for use. In FIG. 2, a receipt paper roll 510 is illustrated.

Referring to FIG. 2, the cutting configuration for the receipt printer, which cuts a part of the receipt paper roll 510 printed by the print head 40, includes a fixed blade 81 mounted to the upper frame 20, and a movable cutter unit 82 mounted on the lower frame 10 to oppose the fixed blade 81 through the paper roll 510 to be driven by a driving source to cut the paper roll 510.

A reference hole is provided for the movable cutter unit 82. A reference shaft 821 is inserted through the reference hole and a reference hole (denoted by the reference numeral 103 of FIG. 1) provided for the lower frame 10 to be precisely positioned with respect to the lower frame 10 to be mounted thereon. Although not shown in FIG. 2, the movable cutter unit 82 has a gear. The gear mates with a gear (not shown) of the driving source mounted on the lower frame 10 when the movable cutter unit 82 is mounted on the lower frame 10. As a result, driving force by the driving source is transmitted to the movable cutter unit 82.

Further, in the printer, the front cover configuration for the receipt printer which covers the front part of the lower frame 10 and the front part of the upper frame 20 includes a first lower cover 61 removably mounted to the lower frame 10 and a first upper cover 71 removably mounted to the upper frame 20. A first paper eject slot 63 for the receipt printer, from which the printed part of the paper roll 510 is ejected, is defined by an end of the first lower cover 61 and an end of the first upper cover 71 opposing the end of the first lower cover 61. A flap 91 for closing the first paper eject slot 63 for dust-proof and water-proof purposes is attached to the first upper cover 71. The flap 91 is made of a lightweight flexible material and therefore does not prevent the paper roll 510 from being ejected.

Further, in the printer, the paper eject configuration for the receipt printer, which guides the paper roll 510 toward the paper eject slot 63, includes a first support path 62 formed on the first lower cover 61 to extend between the movable cutter unit 82 and the end of the first lower cover 61 (the first paper eject slot 63). The paper roll 510 ejected from the first paper eject slot 63 through the first support path 62 is slightly pressed by the flap 91 against the first support path 62 to correct the deflection of the paper roll 510.

The paper eject configuration for the receipt printer further includes a jam sensor for detecting a paper jam based on the raised paper plane of the paper roll 510 on the first support path 62. The jam sensor is provided for the first upper cover 71 to oppose the first support path 62 of the first lower cover 61. The jam sensor includes an optical sensor 74 including a light-emitting element 74*e* and a light-receiving element 74*r* provided on the first upper cover 71, and a paper guide 73 movably attached to the first upper cover 71 to be displaced according to the rise of the level of the paper roll 510 on the first support path 62. Then, detected light, which is emitted from the light-emitting element 74*e* to the light-receiving element 74*r* when the paper guide 73 is displaced based on the rise of the paper on the first support path 62, is to pass. As a result, the jam sensor detects the paper jam of the paper roll 510 on the first support path 62 to stop the operation of the printer.

In this embodiment, the cutting configuration and the front cover configuration are individually attached to the lower frame 10 or the upper frame 20. However, the present invention is not limited thereto. The front cover configuration, the cutting configuration, and even the paper eject configuration may be integrally configured as a single unit. Specifically, the fixed blade 81 may be mounted to the first upper cover 71 to be mounted on the upper frame 20 through the first upper cover 71, while the movable cutter unit 82 may be mounted on the first lower cover 61 to be mounted on the lower frame 10 through the first lower cover 61.

[Ticket Printer]

Figure 3:
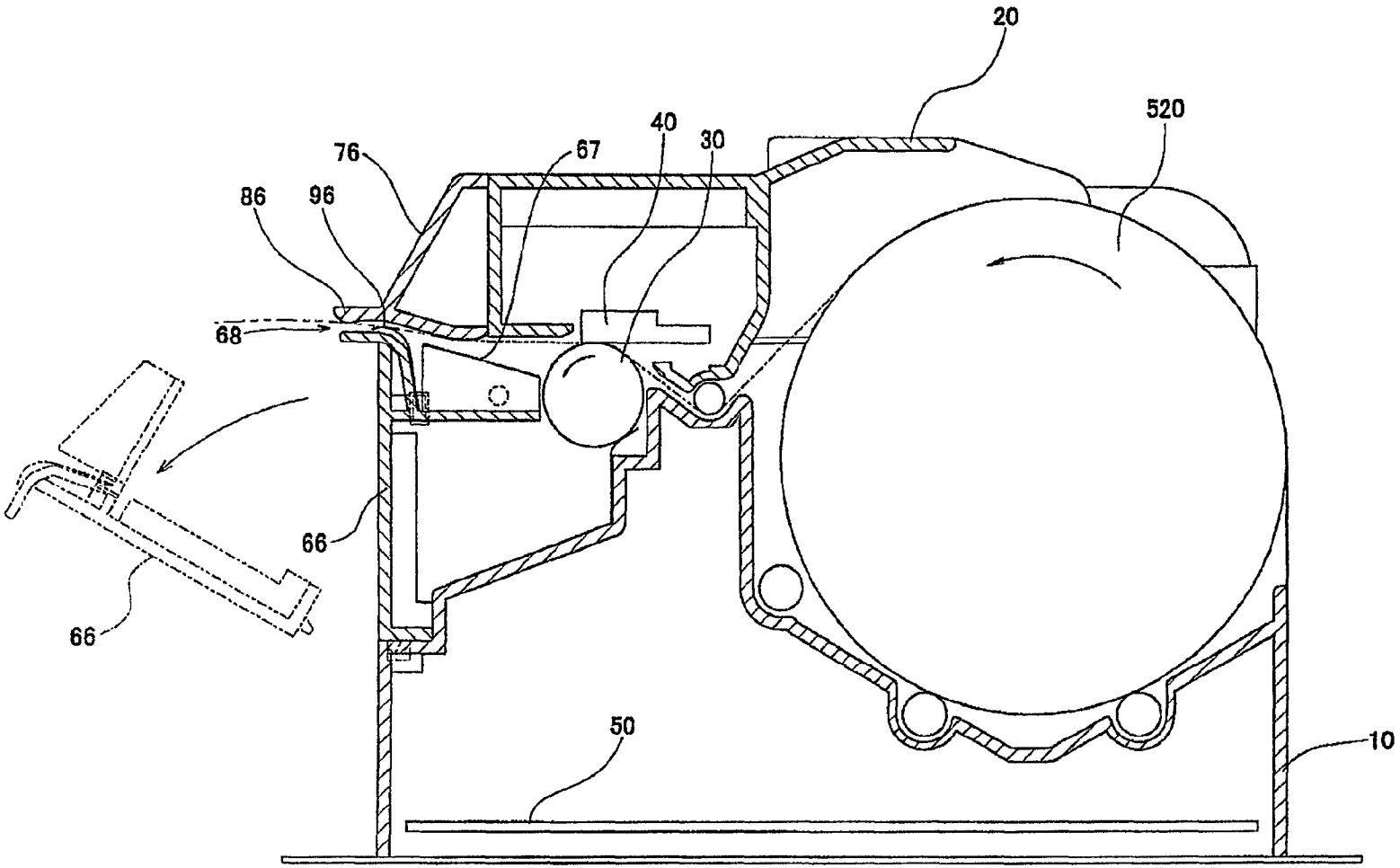
FIG. 3 is a sectional view illustrating a configuration of a ticket printer obtained by adding configurations for the ticket printer (cutting, front cover, and paper eject configurations) to the basic configuration illustrated in FIG. 1.

FIG. 3 illustrates a configuration applied when the configurations for the ticket printer (cutting, front cover, and paper eject configurations) are added to the basic configuration of the printer described referring to FIG. 1 to be assembled into the ticket printer for use. In FIG. 3, a ticket paper roll 520 is illustrated. The ticket paper roll 520 includes a perforated line at each predetermined position (at each predetermined interval) corresponding to one ticket. As a result, a piece of paper corresponding to one ticket can be easily cut by a hand cutter described below.

Referring to FIG. 3, the cutting configuration for the ticket printer, which cuts a part of the ticket paper roll 520 printed by the print head 40, includes a hand cutter 86 mounted to the upper frame 20. The hand cutter 86 may also be mounted to any of the lower frame and both the upper and lower frames.

Further, in the printer, the paper eject configuration for the ticket printer, which guides the paper roll 520 toward the paper eject slot 63, includes a second lower cover 66 removably mounted on the lower frame 10 and a second upper cover 76 removably mounted on the upper frame 20. A second paper eject slot 68 for the ticket printer, from which the printed part of the paper roll 520 is ejected, is defined by an end of the second lower cover 66 and an end of the second upper cover 76 opposing the end of the second lower cover 66. A blade 96 for closing the second paper eject slot 68 for dust-proof and water-proof purposes is attached to the second lower cover 66. The blade 96 is made of a lightweight elastic material and therefore does not prevent the paper roll 520 from being ejected.

In this embodiment, the hand cutter 86 is formed on the end of the second upper cover 76 in an integrated manner. Therefore, the hand cutter 86 is mounted to the upper frame 20 through the second upper cover 76.

Further, in the printer, the paper eject configuration for the ticket printer, which guides the paper roll 520 toward the paper eject slot 68, includes a second support path 67 formed on the second lower cover 66 to extend from the platen 30 toward the end of the second lower cover 66 (the second paper eject slot 68). The paper roll 520 ejected from the second paper eject slot 68 through the second support path 67 is slightly pressed by the blade 96 against a part of the second upper cover 76 which opposes the second support path 67 to correct a deflection of the paper roll 520. At the same time, a front surface of the ticket paper roll 520 is always in substantially close contact with the second upper cover 76. As a result, a print face of the ticket paper roll 520, which is less frequently printed and ejected to cause the end of the ticket paper roll 520 to face the second paper eject slot 68 for long time, can be prevented from being discolored by a ultra-violet ray or other factors.

In this embodiment, after the cutting configuration and the front cover configuration are constituted as a unit, the obtained unit is attached to the lower frame 10 or the upper frame 20. However, the present invention is not limited thereto. Each of the front cover configuration, the cutting configuration, and the paper eject configuration may be individually attached to the lower frame 10 or the upper frame 20.

As is apparent from the above description, the printer according to the present invention has general versatility to allow each of the receipt printer and the ticket printer to be configured. Therefore, the printer according to the present invention has the following effects. Conventionally, the receipt printer and the ticket printer have different cutting configurations. Therefore, a printer main body including the lower frame or the upper frame, on which the cutting configuration is mounted, is differently designed using different components for each of the receipt printer and the ticket printer. On the other hand, the printer according to the present invention has a configuration common to the receipt printer and the ticket printer. Therefore, an assembly or component delivery plan can be established in a streamlined manner to provide excellent productivity.

The exemplary embodiment of the present invention has been described above. However, the invention of the present application is not limited to the above-mentioned embodiment. For example, the present invention is also applicable to printers using print formats other than the format of a thermal printer, for example, a printer having an ink head.

What is claimed is:

1. A printer comprising:

a lower frame on which a paper roll is loaded;

an upper frame openably covering the lower frame;

a front cover configuration covering a front part of the lower frame and a front part of the upper frame;

a print head printing on a paper surface while feeding paper from the paper roll;

a cutting configuration cutting a printed part of the paper roll; and a paper eject configuration guiding the paper cut from the paper roll toward a paper eject slot;

wherein the front cover configuration includes a lower cover removably mounted on the lower frame and an upper cover removably mounted on the upper frame;

wherein the cutting configuration includes a hand cutter, the hand cutter being mounted to at least one of the upper frame and the lower frame and cutting the paper roll pressed onto an edge of the hand cutter;

wherein the paper eject configuration includes a support path and a blade made of elastic material;

wherein the lower cover comprises a lower path wall while the upper cover comprises an upper path wall;

wherein the lower and the upper path walls extend inwardly from the paper eject slot with a space left there-between, so that the support path is formed by the lower and the upper path walls;

wherein the blade comprises a first end and a second end opposite to the first end;

wherein the first end of the blade is attached to the lower cover;

wherein the second end of the blade is constantly urged toward the upper path wall based on its elasticity;

wherein the second end of the blade constantly presses the paper roll onto the upper path wall, so that the paper surface of the paper roll is in constant contact with the upper path wall; and wherein the blade constantly closes up the paper eject slot.

2. The printer according to claim 1, wherein the hand cutter is integrally formed with at least one of the end of the upper cover and the end of the lower cover to be mounted on at least one of the upper frame and the lower frame through the at least one of the upper cover and the lower cover.

3. An electronic appliance, comprising the printer according to claim 1.

4. The printer according to claim 1, wherein the second end of the blade is constantly urged toward a distal area of the upper path wall that is adjacent to the paper eject slot; and wherein the paper surface of the paper roll is in constant contact with the distal area.

* * * * *